United States Patent [19]

Heimbigner

[11] 4,416,452

[45] Nov. 22, 1983

[54] BOWLING BALL FINGER GRIP INSERT

[76] Inventor: Donald L. Heimbigner, 802 Rhododendron Dr., Vancouver, Wash. 98661

[21] Appl. No.: 335,603

[22] Filed: Dec. 30, 1981

[51] Int. Cl.[3] ..... A63B 43/02

[52] U.S. Cl. ..... 273/63 A; 273/DIG. 5

[58] Field of Search ..... 273/63 A, 63 R, 63 B, 273/63 C, 63 D, 63 E, 63 F, 63 G

[56] References Cited

U.S. PATENT DOCUMENTS

| | | | |
|---|---|---|---|
| 2,273,199 | 2/1942 | Hilton et al. | 273/63 |
| 2,842,367 | 7/1958 | Keith | 273/63 |
| 3,004,762 | 10/1961 | Frost | 273/63 |
| 3,012,783 | 9/1961 | Bunk et al. | 273/63 |
| 3,078,097 | 2/1963 | Mitchell | 273/63 A |
| 3,113,775 | 12/1963 | Taylor | 273/63 A |
| 3,148,881 | 9/1964 | Yettito | 273/63 |
| 3,316,588 | 2/1967 | Vezirakis | 18/5.1 |
| 3,342,488 | 9/1967 | Novatnak | 273/63 A |
| 3,416,796 | 12/1968 | Ginder | 273/63 |
| 3,454,440 | 7/1969 | Vezirakis | 156/242 |
| 3,804,412 | 4/1974 | Chetirko | 273/63 A |
| 4,289,312 | 9/1981 | Heimbigner | 273/63 A |

*Primary Examiner*—George J. Marlo

*Attorney, Agent, or Firm*—James D. Givnan, Jr.

[57] ABSTRACT

An insert for removable placement within a finger grip bore of a bowling ball. The insert includes members of different resiliencies forming an uninterrupted truncated conical inner wall surface to enhance both ball retention during the swing of the delivery and subsequent ball release. The softer member is located near the inner extremity of the ball bore to receive the pad of the finger's distal phalange. Insert retention in the ball is by a small amount of adhesive which facilitates insert removal and replacement. Modified forms of the insert also each include a member of softer material but of other than tubular shape which member is embedded within a longer insert member of less resiliency. Methods are disclosed for molding each type of bowling ball insert disclosed. A further modified insert additionally includes a chordally disposed mass or formation against which the outermost phalange of the inserted finger bears during ball retention.

12 Claims, 20 Drawing Figures

BOWLING BALL FINGER GRIP INSERT

BACKGROUND OF THE INVENTION

The present invention relates generally to equipment for the sport of bowling and particularly to a finger grip insert for placement within a ball defined hole such as the insert type shown and described in my earlier filed application of the same title filed under Ser. No. 06/224,113 on Jan. 12, 1981 and now abandoned.

An application on a bowling ball finger grip insert was filed by the present inventor in the United States on Apr. 21, 1980 under Ser. No. 142,407 which application has now issued as U.S. Pat. No. 4,289,312 and discloses an insert having non-uniform wall thicknesses when viewed in transverse section.

By way of background bowling balls are, for the most part, made of hard rubber or a polyester resin. Further, a variation in ball material may exist between an outermost surface layer, approximately one inch thick, and the ball core. Ideally, for the sake of bowling accuracy, interaction between the hole defining surface of the ball and a finger should remain constant to assure consistent ball release. In actuality however, such interaction is not constant because: (1) A bowling ball may be of other than homogeneous construction formed from two or more constituent materials; (2) A professional or serious amateur bowler may own several balls to best suit specific lane conditions which balls may be of hard rubber or polyester resin, each type having different finger and ball interaction and hence distinct "release" characteristics; (3) The fingers may swell somewhat after bowling a length of time to alter fit and subsequent ball release.

It is to be noted that the greatest force applied to the ball hole walls is by the distal or outermost phalanges of the three fingers normally used in bowling. Secure engagement of these phalanges with the hole walls assures ball retention until desired release to thereby avoid ball dropping or at least premature release. Once ball release is initiated however it is highly desirable that it be effected rapidly with a minimum of drag on the hole walls by the departing fingers and particularly the thumb.

Previous efforts to enhance finger-to-ball contact have included the provision of strip-like inserts, insertable lengthwise, for adherence to a lengthwise segment of the hole wall. Additionally proposed have been tube-like inserts having a continuous inner wall which, in some instances, the cross sectional area may be mechanically altered for finger fit. Examples of the latter inserts are found in U.S. Pat. Nos. 3,416,796; 3,148,881; 3,004,762. Also old in the art is a tubular insert of resilient material per U.S. Pat. No. 2,273,199. Further U.S. Pat. Nos. 3,454,440 and 3,316,588 show it to be old to form a rigid insert to generally correspond in shape to the fingers. The latter patent discloses an internally contoured insert of homogeneous construction. U.S. Pat. Nos. 2,842,367 and 3,012,783 disclose assembled finger grip inserts wherein an inner sleeve member extends substantially the length of the insert.

SUMMARY OF THE PRESENT INVENTION

The present invention is embodied in a bowling ball finger grip insert having both desired retention and release characteristics to promote bowling accuracy, The insert is of a resilient nature with an internal surface having a low coefficient of friction for release purposes. A preferred embodiment of the present insert is of resilient materials having different hardness ratings with the softer material located innermost for coaction with the distal phalange of the inserted finger for positive ball retention with the harder material constituting the outermost segment of the insert. A slight inward taper of the tubular insert enhances ball release and finger fit.

One embodiment of the insert includes a downwardly tapering internal wall surface from which a raised, generally chordal formation provides an inclined surface against which the finger outer phalange may bear to facilitate ball retention until desired release. This version of the insert preferably includes a softer insert portion for phalange pad contact.

Important objects of the present invention include the provision of a bowling ball insert assuring positive ball retention preparatory to intended ball release with provision made for unhindered finger extraction; an insert for use in any finger (including thumb) hole of the ball which insert is readily mounted and detachable from the ball enabling insert substitution or ball inspection as required under some tournament regulations; an insert comprised of materials having different hardness ratings directed toward both ball retention by the fingertip and unhindered ball release; a tapered insert enabling ball gripping to be accomplished primarily with the distal phalange of the finger or fingers; an insert when installed in each of the bowler's balls provides a consistent feel and release regardless of the type of material the ball is formed from; an insert with a resilient member which receives the fingertip pad; an insert having an elevated chordal formation.

DETAILED DESCRIPTION OF THE PREFERRED EMBODIMENTS

Figures 1, 2, 3, 4, 5, 6, 7, 8, 9, 10, 11:
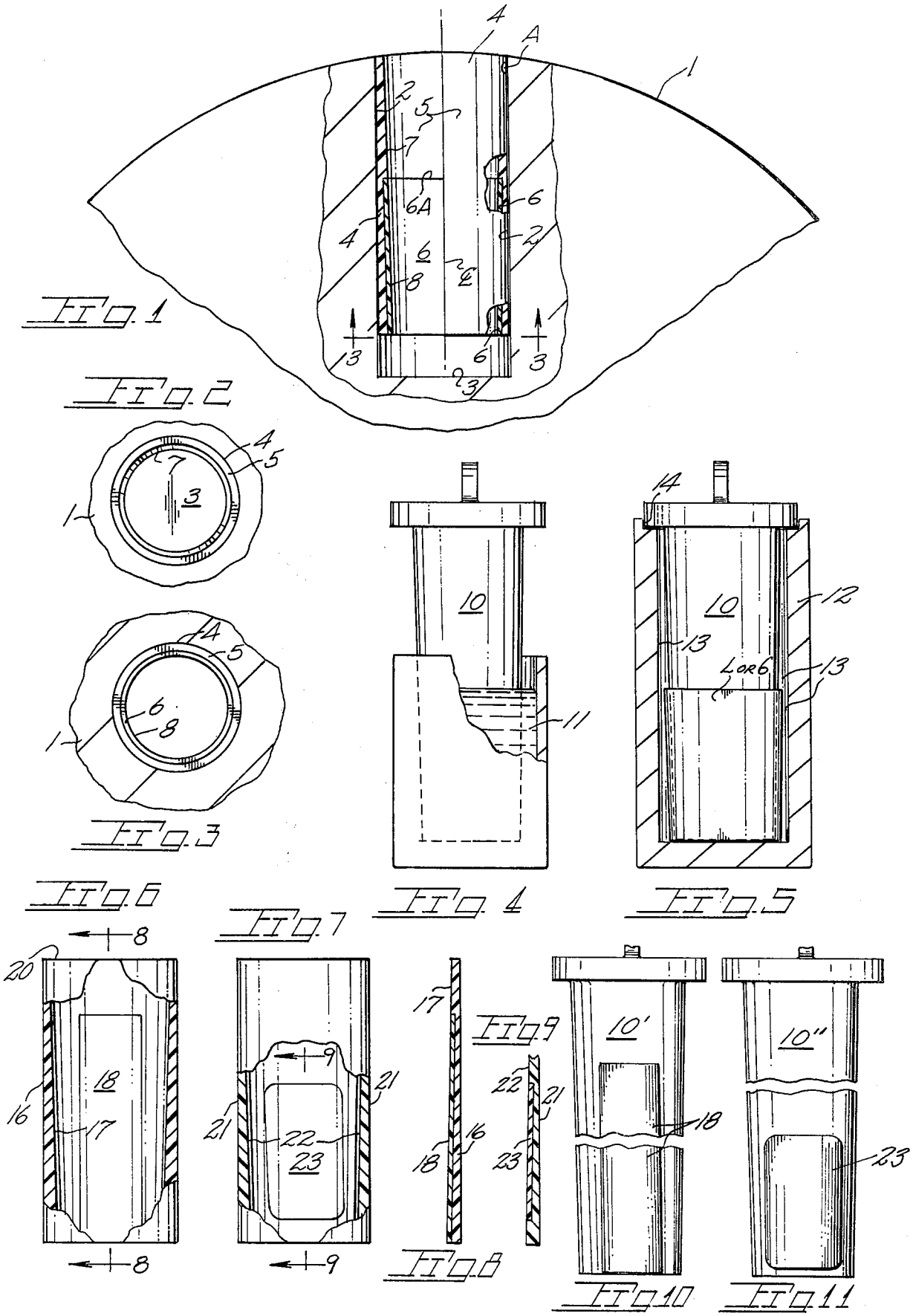
FIG. 1 is a view of a bowling ball fragment with structure broken away to disclose a finger opening and the present insert therein.
FIG. 2 is a top plan view of the insert.
FIG. 3 is a bottom plan view of the insert taken upwardly along line 3—3 of FIG. 1.
FIG. 4 is an elevational view of a mold core partially submerged in resilient material in a molten state.
FIG. 5 is an elevational view of a mold with the latter broken away to disclose an inserted mold core with resilient material adhering to the core lower segment.
FIGS. 6 and 7 are side elevational views of modified finger grip inserts with fragments broken away for purposes of illustration.
FIGS. 8 and 9 are vertical sectional views taken respectively along line 8—8 and 9—9 of FIGS. 6 and 7.
FIGS. 10 and 11 are side elevational views of mold cores each affixed with a different shaped patch of resilient material preparatory to cavity insertion of the cores.
Figure 20:
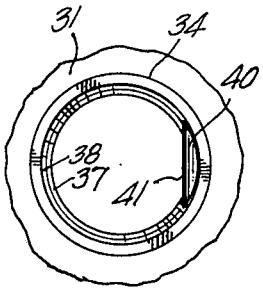
FIG. 20 is a top plan view of a modified insert taken along line 20—20 of FIG. 12.

With continuing attention to the drawing, the reference numeral 1 indicates a bowling ball fragment with the ball material broken away to show a bore or opening defined by a continuous wall 2. A bore end wall is indicated at 3. Typically the bore will have a depth of from two and one-half to three inches to suit the size of the user's hand and finger penetration.

In the preferred embodiment a tubular finger grip insert at 4 includes a first member 5 of tubular shape secured within the ball bore in a manner later described. Indicated at 6 is a second member shown as a sleeve formed integral with first member 5. Sleeve shaped second member 6 is of greater resiliency than member 5. Sleeve 6 is located during insert installation so as to receive the pad of the distal phalange of the inserted finger with the distal joint being located approximately at the sleeve's upper extremity at 6A. Accordingly, as it is the distal phalange that is utilized primarily in exerting gripping power on a ball, the sleeve shaped second member 6, inset within the first member, readily yields to fingertip pressure. In so called "fingertip" bowling balls, it will be understood that member 6 and particularly upper extremity 6A thereof will be located at or adjacent the ball surface.

With attention again to first member 5, the same has an inner wall 7 which is continuous with an inner wall 8 of second member 6 with the inner walls formed on a downward taper to jointly define a truncated cone. Such a taper is provided for purposes of finger fit to better accommodate the slightly tapered configuration of the finger. Such tapering assures an optimum fit of inner wall 8 with the distal phalange. The wall section shown in FIG. 1 is typical. For an insert for use in the thumb hole of a ball a size range of top inside diameters of from thirteen-sixteenths of an inch to one and one-sixteenth inches with the bottom inside diameter respectively one-sixteenth inch less in an insert of two and three-quarters inch length. The length may be reduced after installation in the ball by cutting off any exposed segment.

A method of producing the present insert includes the steps of dipping a core at 10, heated to approximately 350–375 degrees, F., into a quantity of molten vinyl material 11 to apply a jelled layer L (subsequently becomes sleeve member 6) which is then heat fused in an oven at the same temperature. Core 10 is formed on a downward taper. Said core with the heat fused coating thereon, approximately one-thirty-second of an inch thick, is subsequently transferred for insertion into a mold 12 having a cylindrical cavity 13. Mold 12 is shaped as at 14 to assure concentric spacing between the core and mold inner wall 13. The annular space between the core and mold wall 13 is subsequently charged with like molten vinyl material forming insert member 5 which is compatible and cohesive with the solidified resilient sleeve 6 and adheres to same to form the unitary insert 4. Upon setting of the last mentioned material, core 10 is removed from the mold and the completed insert stripped from the core. The mold is suitably vented and gated.

A suitable material for manufacture of the present insert is that vinyl material sold under the registered trademark Chem-o-sol sold by the Chemical Products Division of the Chem-o-sol Company. With continuing attention to but one satisfactory form of the insert, second member 6 is of the above mentioned material having a Shore durometer rating of Type A-2 (10 sec. indentation) of 50 with the first member of the insert formed of like vinyl material but less resilient having a Shore durometer rating Type A-2 (10 sec. indentation) of 98. Obviously, the resiliency may be varied within the above criteria.

The insert is secured within the drilled ball opening by means of an epoxy type adhesive such as that sold under the trademark SUPER GLUE. It has been found that a single drop of such an adhesive at A located between the insert and ball bore 2, proximate the insert outer end, will retain the insert in place yet permit rapid insert removal by use of a pocket knife blade without ball damage. Accordingly, the practice of enlarging the size of a finger opening, such as is currently done by removing layers of tape from a ball bore wall, is avoided simply by removal and substitution of an insert having a different internal size. The problem of finger enlargement or swelling after a period of bowling resulting in fit problems is accordingly overcome by insert substitution.

As earlier noted, a bowler may find it desirable to use a number of different bowling balls which without an insert would have a different "feel" and release characteristics, all of which is remedied by a readily interchangeable insert with further variance permitted by having a number of inserts with differing internal diameters all of which may be received within ball bores of uniform diameter. Further, the present insert, by reason of being secured by a very small amount of adhesive, can be quickly removed for ball inspection purposes by tournament officials.

The use of a less resilient material in first member 5 results in the finger encountering less friction or drag when exiting the insert at ball release to contribute to rapid ball release particularly when the insert is in the thumb hole of the ball. Further, the less resilient first member is less susceptible to damage during insert removal than if the insert were formed entirely of the softer material of the second insert member.

FIGS. 6 through 11 are concerned with modified finger grip inserts wherein the member of greater resiliency is non-continuous, i.e., other than of closed annular configuration.

FIG. 6 discloses a first finger engageable member at 16 having an inner wall at 17 of inwardly and downwardly tapered configuration tapered to the same extent as the first described insert or approximately two degrees. A second finger engageable member at 18 of the insert is of greater resiliency than first member 16 and is of strip to elongate configuration extending a major distance of the insert length and terminating one-half inch or so from the upper end 20 of the insert.

In FIG. 7, I show still another form of the insert and having a first finger engageable member at 21 having an inner wall at 22 also downwardly tapered. A second finger engageable member at 23, of greater resiliecy than first member 21, is of generally rectangular or patch shape and located within the lower half of the insert.

In both of the last two described forms of inserts the second or more resilient members of the inserts are cut from sheets of resilient material and then affixed respectively to mold cores 10′ and 10″ per FIGS. 10 and 11. Accordingly, in insert fabrication, the step earlier illustrated in FIG. 4 is dispensed with and instead the second member 18 or 23 is simply placed onto the heated core 10' or 10" prior to core deposit into the mold cavity 13. Subsequent filling of the cavity with molten material as earlier noted results in the first member, when jelled, adhering to the core mounted second member. Completion of the insert entails core removal from the cavity and subsequent stripping of the completed unitary insert therefrom. The vinyl material used in these latter forms of the invention may be of the type earlier described. The dimensions of the inserts may be as earlier noted.

Figure 12:
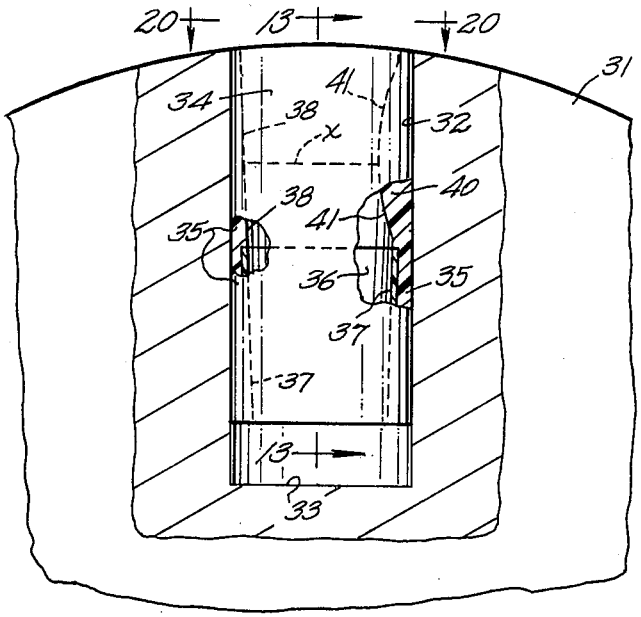
FIG. 12 is a view similar to FIG. 1 but showing a modified form of ball insert.

With attention directed to that form of the present insert viewed in FIG. 12, the same is best suited for placement in the thumb receiving bore 32 of the ball at 31. A bore end wall is at 33 with the ball bore depth being as earlier noted.

A tubular finger grip insert at 34 includes a first finger engageable member at 35 of tubular shape for securement in bore 32 in the manner earlier noted.

A second finger engagable member 36 is also of sleve shape but of lesser length than first member 35 and located within the lower portion of the insert to receive the pad of the thumb outer phalange. An inner wall 37 of shorter sleeve 36 is of truncated conical shape and continuous with an inner wall 38 of first member 35. The surfaces of both walls 37 and 38 define a slightly tapered truncated cone tapering downwardly and inwardly on about a two degree taper.

Figure 13:
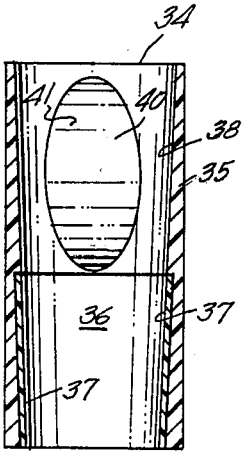
FIG. 13 is a vertical medial sectional view taken along line 13—13 of FIG. 12.

The modified insert structure shown in FIGS. 12 and 13 includes a chordally disposed mass resulting in a raised or elevated formation at 40 bounded by an inwardly extending, curved wall surface 41. Surface 41 may be arcuate. Upon thumb insertion, the distal phalange therof is located with the pad thereof bearing partially on wall 37 of resilient member 36 and partially on wall surface 41 of raised formation 40. It should be remembered that such locationing of the thumb is intended to be only typical with individual users preferences dictating actual thumb placement. The raised chordal formation or mass 40 accordingly enhances the gripping action of the thumb. Retraction of the distal or outer phalage of the thumb from the insert during ball release is not encumbered by raised formation 40 by reason of the fact that the human thumb pad, as viewed in side elevation, is of pronounced outward convergence. The internal crosswise dimension indicated at X of the insert is, regardless of formation 40, adequate to permit outward unobstructed withdrawal of the thumb outer phalange during ball release. The maximum radial depth of the chordal formation 40 (not including insert wall thickness) may be approximately one-eighth inch. Chordal formation 40 is of elongate configuration extending lengthwise along the upper portion of the insert.

Figure 18:
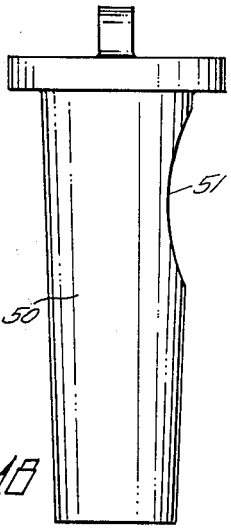
FIG. 18 is a side elevational view of a mold core for forming the modified thumb insert.
Figure 14:
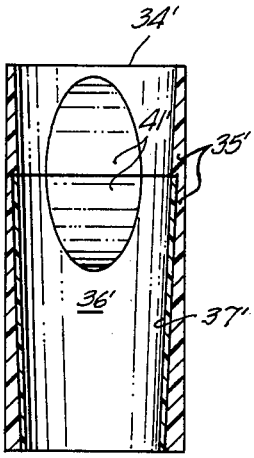
FIGS. 14 through 17 are similar to FIG. 13 but show still further modified forms of the insert for thumb reception.

In FIG. 14, I show another modified insert 34' having a first finger engageable member 35' with an insert second finger engageable member at 36'. Insert structure analogous to the preceding insert is indicated by prime reference numerals. Second member 36' is formed by increasing the depth of submergence of a modified mold core at 50 (FIG. 18) in molten resilient material in the method described earlier. Said mold core is of downwardly tapering configuration with a recessed area 51 for forming the chordal mass on all of the modified inserts. The molten resilient coating is applied to the mold core up to approximately the middle of core wall 51. Said core is thereafter heat fused and again submerged to form first member 35' of the tubular insert. An elevated wall surface at 41' accordingly has a partial or lower exterior of greater resiliency than the remaining upper portion of said wall surface.

Figure 15:
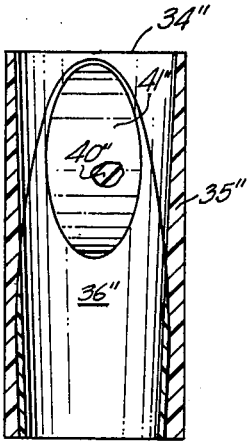
Figure 19:
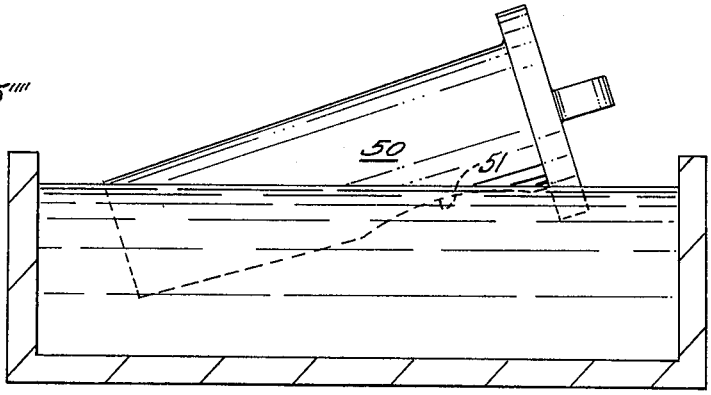
FIG. 19 is a side elevational view in schematic form of a mold core partially submerged in molten resilent material.

In FIG. 15 a still further insert modification is shown at 34" wherein a first finger engageable member at 35" of the insert has a second finger engageable member at 36" embedded therewithin much in the same manner as the earlier described inserts of FIG. 14. More resilient second member 36" extends in an inclined manner substantially the length of the insert to constitute an exterior wall surface 41" of raised formation 40" having an inclined upper terminous. This insert is formed by initially dipping modified core 50 in an inclined manner as per FIG. 19 to fully coat wall 51 of the core and thereafter placing the partially coated core in a mold as earlier described. First finger engageable member 35" extends in an inclined manner substantial the length of the insert.

Figure 16:
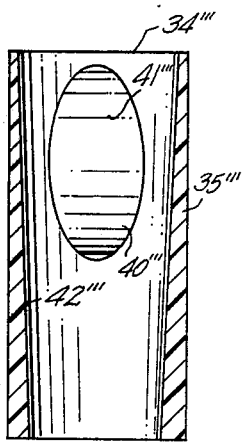

In FIG. 16 an insert 34''' is disclosed wherein a second member of greater resiliency has been dispensed with and the insert formed in a homogenous manner. When formed from material having a Shore durometer rating of type A-2 (10 sec. indentation) of 98, the insert facilitates more rapid thumb extraction and hence quicker ball release than inserts of multi-resilient composition. The insert of FIG. 16 minimizes lofting of the ball and achieves early alley contact of the ball important when alley surfaces have a low coefficient of friction. A tapered inner wall surface of the insert is at 42'''. A chordal mass is at 40''' have a surface 41''''.

Figure 17:
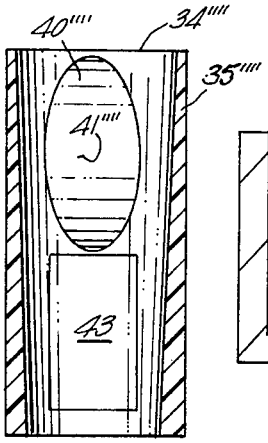

In FIG. 17, a tubular insert 34'''' includes a first finger engageable member 35''''. A second finger engageable member at 43 is generally of rectangulr shape and is of greater resiliency than the first member. Said second member is initially applied to the exterior of core 50 below wall 51 thereof in the general manner described with the earlier mentioned inserts. Casting of the insert with the rectangular second member in place on the core results in the second member becoming embedded within the first member. A chordal mass is indicated at 40'''' having a surface 41''''.

While the term chordal is used in the foregoing description it is to be understood that surface 41 of the chordal mass 40 is not restricted to a surface curved in but one direction but rather may include those masses bounded by an exterior wall surface of complex curvature.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

1. A finger grip insert for bowling balls, said insert comprising, a first finger engageable member of tubular shape for recessed securement within a bowling ball defined bore and having a truncated conical inner wall for contact with an inserted finger, a second finger engageable member formed integral with and inset within said first member and of a resilient nature and being of greater resiliency than said first member for contact by the fingertip pad of the inserted finger, said second finger engageable member being inset within said first finger engageable member so as to provide an uninterrupted internal wall surface of the insert.

2. The insert claimed in claim 1 wherein said second member is of tubular configuration.

3. The insert claimed in claim 2 wherein the second member has a truncate conical inner wall surface with its smaller inside diameter adapted for placement toward the ball center.

4. The insert claimed in claim 3 wherein said inner wall surfaces of the first and second members jointly define the surface of a truncated cone.

5. The insert claimed in claim 1 wherein said second member is of elongate configuration.

6. The insert claimed in claim 1 wherein said second member is generally of rectangular configuration.

7. The insert claimed in claim 1 wherein said first finger engageable member includes a chordal mass constituting an elevated formation for finger engagement.

8. The insert claimed in claim 7 wherein said chordal mass is located primarily within the upper portion of the insert with respect to a bowling ball center.

9. The insert claimed in claim 7 wherein said chordal mass is bounded by a curved wall surface.

10. The insert claimed in claim 9 wherein the curved wall surface is arcuate.

11. The insert claimed in claim 7 wherein at least a portion of said second finger engageable member is inset within said chordal mass.

12. The insert claimed in claim 11 wherein said second finger engageable member fully overlies and constitutes the surface of said chordal mass.

* * * * *